US006453147B1

(12) United States Patent
Morse et al.

(10) Patent No.: US 6,453,147 B1
(45) Date of Patent: Sep. 17, 2002

(54) DUST CONTROL IN CONDUCTIVE-CORE FIBER BRUSH CLEANING SYSTEMS USING SELF-GENERATED AIR FLOW

(75) Inventors: Theodore H. Morse, Irondequoit; David L. Thompson, West Henrietta, both of NY (US)

(73) Assignee: Nexpress Solutions LLC, Rochester, NY (US)

( * ) Notice: Subject to any disclaimer, the term of this patent is extended or adjusted under 35 U.S.C. 154(b) by 0 days.

(21) Appl. No.: 09/730,368

(22) Filed: Dec. 5, 2000

Related U.S. Application Data

(60) Provisional application No. 60/225,544, filed on Aug. 16, 2000.

(51) Int. Cl.[7] ..... G03G 21/00
(52) U.S. Cl. ..... 399/353; 399/355
(58) Field of Search ..... 399/92, 353, 355

(56) References Cited

U.S. PATENT DOCUMENTS 3,917,397 A * 11/1975 Tanaka et al. ..... 399/354
3,965,524 A * 6/1976 Kurita et al. ..... 399/353 X
3,969,785 A * 7/1976 Ogawa et al. ..... 399/353 X
4,205,911 A * 6/1980 Dole ..... 399/355
4,851,880 A * 7/1989 Ziegelmuller et al. ..... 399/355
5,479,249 A * 12/1995 Jugle et al. ..... 399/353 X
5,652,946 A 7/1997 Scheuer et al. ..... 399/49
5,652,951 A 7/1997 Thayer et al. ..... 399/71
5,682,578 A * 10/1997 Shehata et al. ..... 399/92
5,991,568 A 11/1999 Ziegelmuller et al. ..... 399/102
6,009,301 A 12/1999 Maher et al. ..... 399/353

* cited by examiner

*Primary Examiner*—William J. Royer
(74) *Attorney, Agent, or Firm*—James D. Leimbach

(57) ABSTRACT

A method and apparatus of forming a cleaning system for an electrostatographic reproduction system having a photoconductive drum partially within a cleaning system housing and a cleaning brush having conductive core fibers within the cleaning system housing contacting the photoconductive drum with a detoner roller also within the cleaning system housing contacting the cleaning brush. The cleaning system housing is provided with ports that allow for air in enter of leave the cleaning system housing. A curved deflector plate is positioned such that it is spaced about ⅛" from the cleaning brush. The deflector plate is attached to the enclosure on a side where the brush fibers are moving towards the detoner roller. A skive is made to contact the detoner roller, a baffle is formed contacting the skive and a side of the cleaning housing. The cleaning system is preferably designed such that the ratio of engagements of the detoner roller to the cleaning brush compared to that of the toner bearing surface to the cleaning brush, is essentially three to one.

34 Claims, 4 Drawing Sheets

DUST CONTROL IN CONDUCTIVE-CORE FIBER BRUSH CLEANING SYSTEMS USING SELF-GENERATED AIR FLOW

CROSS REFERENCE TO RELATED APPLICATION

Reference is made to and priority claimed from U.S. Provisional Application Ser. No. 60/225,544, filed Aug. 16, 2000, entitled DUST CONTROL IN CONDUCTIVE-CORE FIBER BRUSH CLEANING SYSTEMS USING SELF-GENERATED AIR FLOW.

BACKGROUND OF THE INVENTION

1. Field of the Invention

The present invention relates to toner cleaning systems for electrophotographic equipment and, more particularly, to controlling the air flow within the cleaning chamber that contains the cleaning brush and detoner mechanism.

2. Description Relative to the Prior Art

Electrophotographic equipment employs a process for transfer of images that typically use marking particles to form the transferred image. Very commonly, the marking particles are placed on a photoconductor surface (such as a photoconductive drum) using toner as the marking particles. A cleaning process is employed after the image has been transferred to remove excess toner. The cleaning process conventionally employs a cleaning brush having either conductive-core fibers or non-conductive fibers, each of which present their own, individual set of problems. More conventional fur brush (conductive base) types of cleaning systems typically have conductive exterior portions with non-conductive cores. These fur brush based cleaning systems typically do require vacuum supply systems. In conductive-core fiber brush cleaning systems, the exterior of the cleaning brush fibers is non-conductive while the interior core is conductive. In these conductive core based systems, the toner is typically removed from the photoconductor surface by mechanical and electrostatic forces. The toner is then extracted from the cleaning brush by the electrically biased detoner roller. Vacuum supply systems are not needed to remove toner from the photoconductor surface to a waste receptacle in conductive core based systems.

Conductive core based cleaning systems provide advantages in the elimination of the vacuum systems yielding a reduction of system cost, noise levels and power requirements over conventional fur brush cleaning systems. There are also shortcomings in toner particles being thrown from the rotating cleaning brush, or other sources within the cleaning station and drifting out of the housing contaminating other areas of the copier. Accordingly, from the foregoing discussion it should be apparent that there remains a need within the art for a system that provides increase control over airborne toner particles without the need for a vacuum.

SUMMARY OF THE INVENTION

This present invention provides a means of reducing and controlling air circulation in cleaning station housings for systems not having a vacuum. The problem of machine contamination by marking particles (such as toner) that are airborne, escaping from the cleaning station is addressed by the method and apparatus of the present invention, wherein the level of airborne toner is greatly reduced. Within the cleaning station, there are two mechanisms that produce air motion. The first involves the moving surfaces of the cleaning brush and detoner roller, is "drag" as air near the surfaces moves in the direction of rotation of the cleaning brush and the detoner roller. This is a well-known aerodynamic phenomenon, resulting from the viscous property of air. The second mechanism involves the compression and expansion of the cleaning brush nap as it engages the photoconductor surface and the detoner roller.

As will be shown in the following description, the method and apparatus of the present invention uses these two mechanisms to generate favorable airflow patterns in and around the cleaning station assembly. This and other features are provided by a cleaning system for an electrostatographic reproduction system having a photoconductive drum partially within the cleaning system housing, with a cleaning brush having conductive core fibers within the cleaning system housing contacting the photoconductive drum, and a detoner roller within the cleaning system housing contacting the cleaning brush. The cleaning system housing is provided with ports that allow for air to enter of leave the cleaning system housing. A curved deflector plate is positioned on a side of the cleaning enclosure where the cleaning brush fibers are moving towards the detoner roller. The cleaning system is preferably designed such that the ratio of engagements of the detoner roller to the cleaning brush compared to that of the toner bearing surface to the cleaning brush, is essentially three to one.

The invention and its objects and advantages will become apparent upon reading the following detailed description and upon reference to the drawings, in which:

DETAILED DESCRIPTION OF THE PREFERRED EMBODIMENTS

Figure 1:
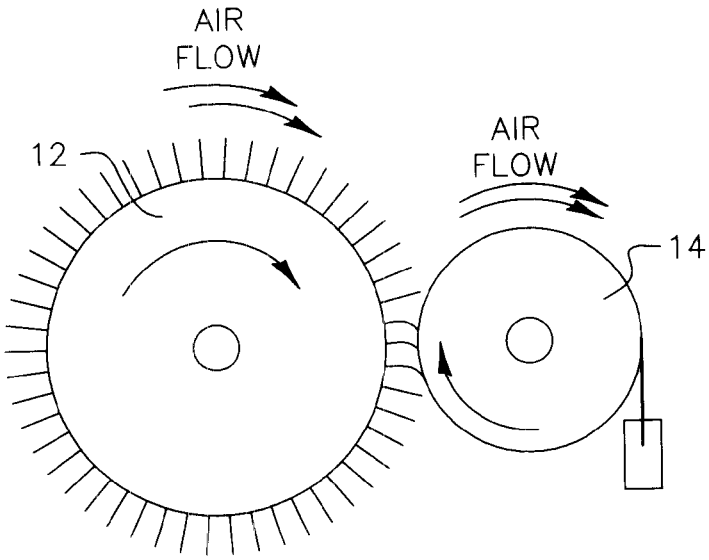
FIG. 1 (PRIOR ART)
FIG. 1 is diagram showing an electrostatographic reproduction system as envisioned by the present invention and the viscous drag that occurs at interfaces in a cleaning chamber.
Figure 2:
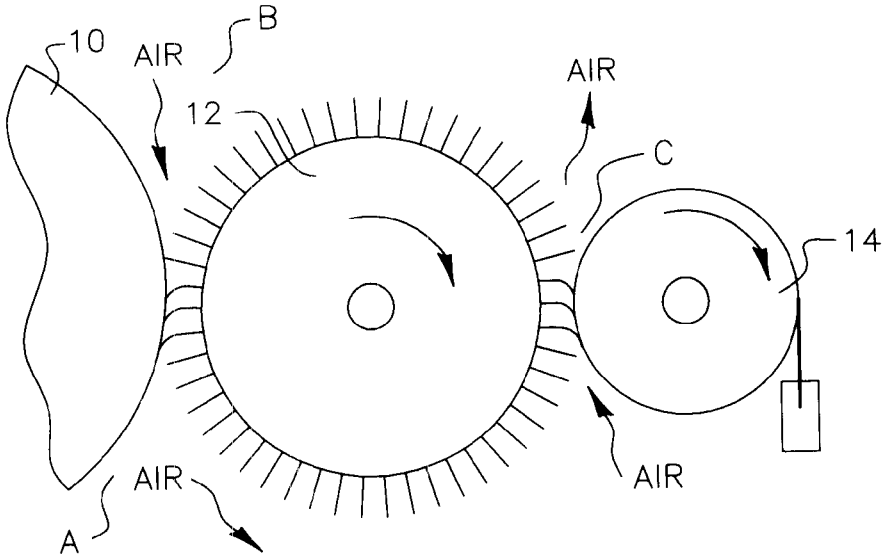
FIG. 2 (PRIOR ART)
FIG. 2 is a diagram showing the nip-pumping effect of the diagram of FIG. 1.

Referring to FIG. 1 in conjunction with FIG. 2, in conductive-core fiber brush cleaning systems, a cleaning system for an electrostatographic reproduction system having a photoconductive drum 10 partially within the cleaning system and a cleaning brush 12 having conductive core fibers within the cleaning system contacting the photoconductive drum. The cleaning brush 12 is used to remove marking particles (such as toner) from a photoconductor surface on drum 10 by mechanical and electrostatic forces. The toner is then extracted from the cleaning brush 12 by an electrically biased detoner roller 14. Since the fibers on the cleaning brush are conductive-core type fibers, a vacuum supply system is not needed to remove the toner from the photoconductor surface to a waste toner receptacle. These vacuums are typically required by conventional fur brush cleaning systems that do not employ conductive-core fibers.

The system that is shown in FIG. 1, as stated above, does not have a vacuum system. The elimination of the vacuum system provides advantages in system cost and reduced noise levels and power requirements. However, the lack of a vacuum also results in a reduction in the control of the airborne toner particles and this is an undesirable result. Toner particles that are thrown from the rotating cleaning brush, or other sources within the cleaning station, can drift out of the housing and contaminate other areas of the reproduction apparatus. The present invention addresses the problem of airborne toner escaping from the cleaning station and contaminating the machine by advantageously utilizing the aerodynamics of the moving surfaces of the cleaning brush and detoner roller. These surfaces create "drag" in their direction of rotation, as seen in FIG. 1 as "air flow". "Drag" involves the moving surfaces of the cleaning brush and detoner roller, that "drag" air near their surfaces in their direction of rotation. This is a well known aerodynamic phenomenon, resulting from the viscous property of air.

The second mechanism involves the compression and expansion of the cleaning brush nap as it engages the photoconductor surface (region A and B ) and disengages from the detoner roller (C), as seen in FIG. 2.

As will be shown in the following description, these two mechanisms can be utilized to generate favorable air flow patterns in and around the cleaning station assembly.

Referring to FIG. 1, a rotating cleaning brush 12 and detoner roller 14 have rotational movements that create air flow due to the "viscous drag" at the interfaces. This air flow will form a curved vector force near the moving surfaces, the magnitude and direction of significant air flow is limited to a region close to the moving surfaces, perhaps a few millimeters in depth. This has been verified by introducing the vapors generated by solid $CO_2$ in water to the region of interest, and observing the visible flow pattern.

FIG. 2, illustrates the mechanism of "nip-pumping" wherein the fibers of the cleaning brush 12 are deflected as they come into contact with the surface of photoconductive drum 10, and air is excluded from the brush nap into the region "A" below the brush. As the fibers leave the surface of the photoconductive drum and return to their normal configuration, air from region "B" is taken into the brush as the volume of the brush nap returns to normal. If there is no direct path for air flow between regions "A" and "B", the nip-pumping mechanism results in a net air flow from region "B" to "A" is realized. The same pumping action occurs in the nip, indicated as C, where the cleaning brush engages and disengages from the detoner roller. The direction of the air flow is as indicated by the arrows in FIG. 2.

As will be shown in the following examples, these two air flow-generating mechanisms can be used to optimize air flow conditions in and around the cleaning station and greatly reduce contamination due to airborn toner.

EXAMPLE 1

This example shows how the mechanism of air drag due to the viscosity of air can be used advantageously in controlling toner dust.

Figure 3:
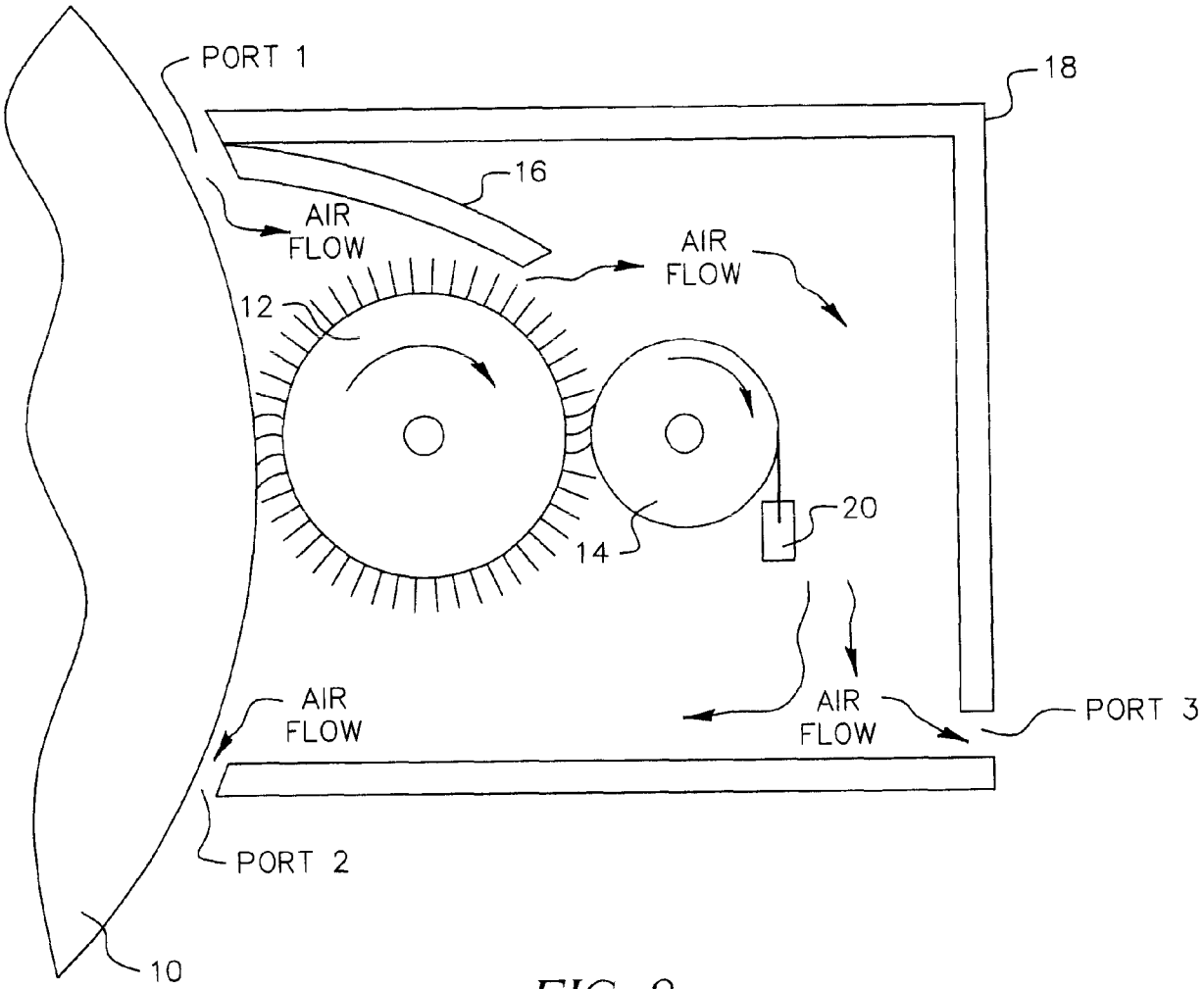
FIG. 3 is a diagram of a fiber brush cleaning system according to the present invention with a curved deflector.

FIG. 3 shows a cross section of a conductive-core fiber brush cleaning system in contact with a photoconductive drum 10. A curved deflector plate 16 has been installed within the housing 18 and an exit opening preferably in the form of a slot, designated Port 3, is provided. Openings between the cleaning station housing 18 and the photoconductive drum are called Port 1 and Port 2. Skive 20 is used to remove toner from the detoner roller 14 in a conventional manner. The cleaning brush 12 and detoner roller 14 are rotated in the directions indicated by the arrows, which in this example is a clockwise rotation.

The ⅛ spacing provided maximum air flow into Port 1 and out of Port 3 using a 2 inch diameter cleaning brush. Air flow increased proportionally with cleaning brush rpm. We did not experiment with cleaning brushes of different diameters. I can only estimate that the ⅛ inch spacing would work well for rollers with diameters ranging from 1 inch to 6 inches.

Using a hot-wire anemometer, it was found that air is taken into the housing at Port 1 and that air exits at Port 3. Some air is also found to exit at Port 2. It was found that this air flow through the housing could be increased greatly by the inclusion and positioning of the interior deflector plate 16. Maximum air flow was obtained with the deflector plate in the position shown, with about ⅛" spacing between its lower surface and the cleaning brush. Greater or smaller spacing results in significantly lower air flow velocities. It is specifically envisioned that toner in the air exiting from Port 3 can be captured by a filtration system.

EXAMPLE 2

Figure 4:
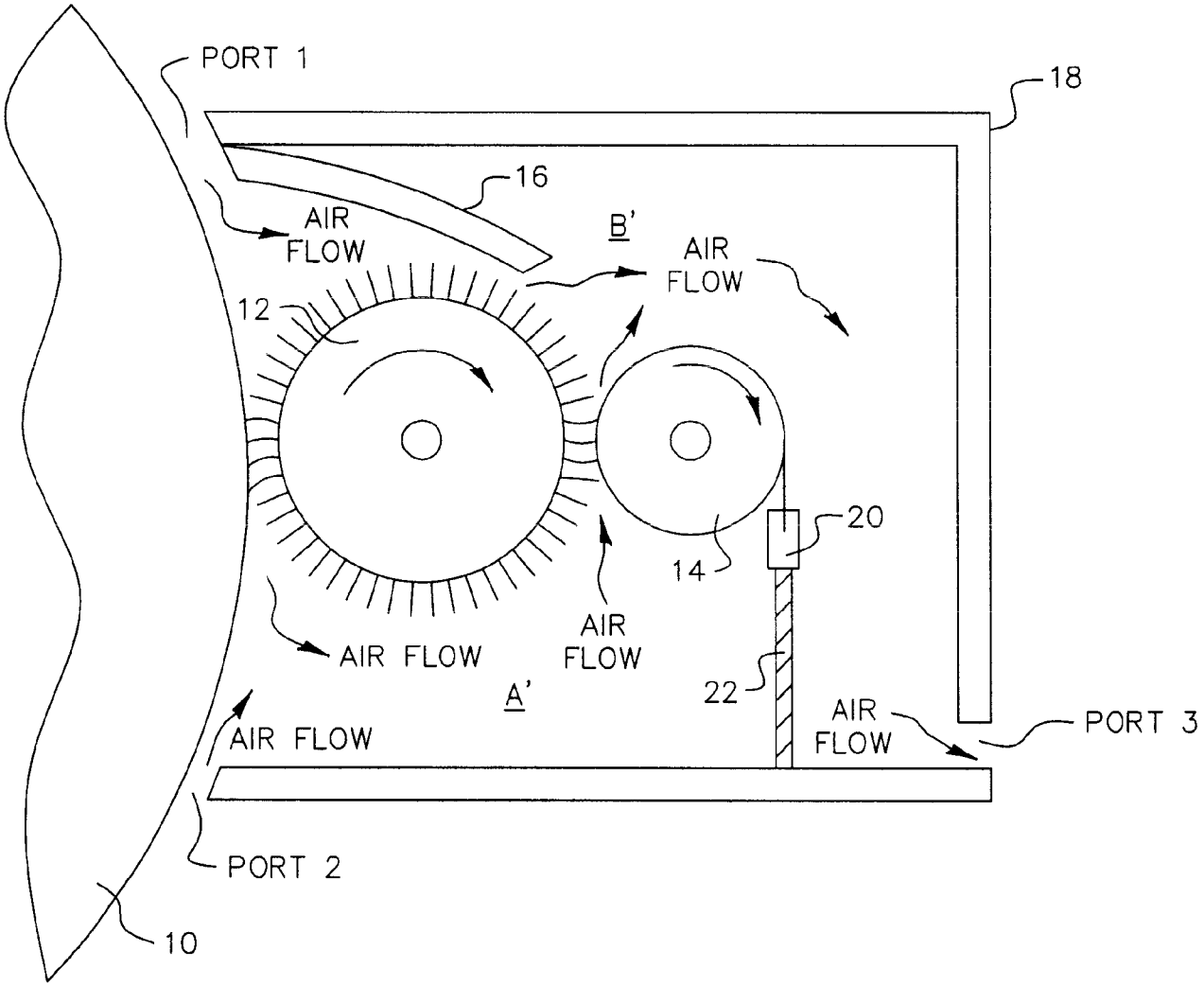
FIG. 4 is a diagram of an alternate embodiment of a fiber brush cleaning system as envisioned by the present invention with an additional baffle.

In Example 1 above, the air leaving the housing at Port 2 will still cause contamination in areas outside this port. Example 2, detailed below, shows how this problem is solved in this example. A baffle 22 has been added to the inside of the housing 18, as shown in FIG. 4. The baffle 22 extends from skive 20 to the bottom of the housing 18, dividing the housing 18 into two basic regions, indicated as A' and B'. Airflow through the housing from Port 1 to Port 3 is maintained, and enhanced by the deflector plate 16. In region A', below the brush 12, air flow by virtue of viscous drag can only circulate within this region, as there is only one opening.

The mechanism of nip pumping can be utilized to move air either into or out of region A', via Port 2.

Separating regions A' and B' are two brush nips. With the indicated directions of roller rotation, the brush/detoner nip will take air from region A' into the brush, and at the brush/PC nip, air from the brush nap will be forced out into region A'.

The net air flow into or out of region A' is determined by the relative engagements of the cleaning brush 12 with the detoner nip roller 14 and with the photoconductive drum 10. It will be readily understood to those skilled in the relevant arts, that a photoconductive web can be used in place of the photoconductive drum 10. When the engagement of the brush 12 with the photoconductive drum 10 is greater than with the detoner nip roller 14, the excess air in region A' will exit at Port 2. When the brush 12 engagement with the detoner nip roller 14 is greater than with the photoconductive drum 10, air will flow into region A' through Port 2. This latter condition provides the desired airflow for the control of airborne toner in the vicinity of Port 2.

The net airflow into Port 2 is carried from region A' into region B' within the nap of the brush 12, and exits the brush 12 into region B' where the brush 12 enters into engagement with the detoner roller 14. It combines with the airflow coming in from Port 1 and continues to the exit at Port 3.

From these examples it is shown that beneficial airflow can be created and controlled within the cleaning station itself, with no external equipment or power required. The engagements and roller speeds required to provide this desirable result are within the ranges required for satisfactory cleaning of the photoconductor surface.

Figure 5:
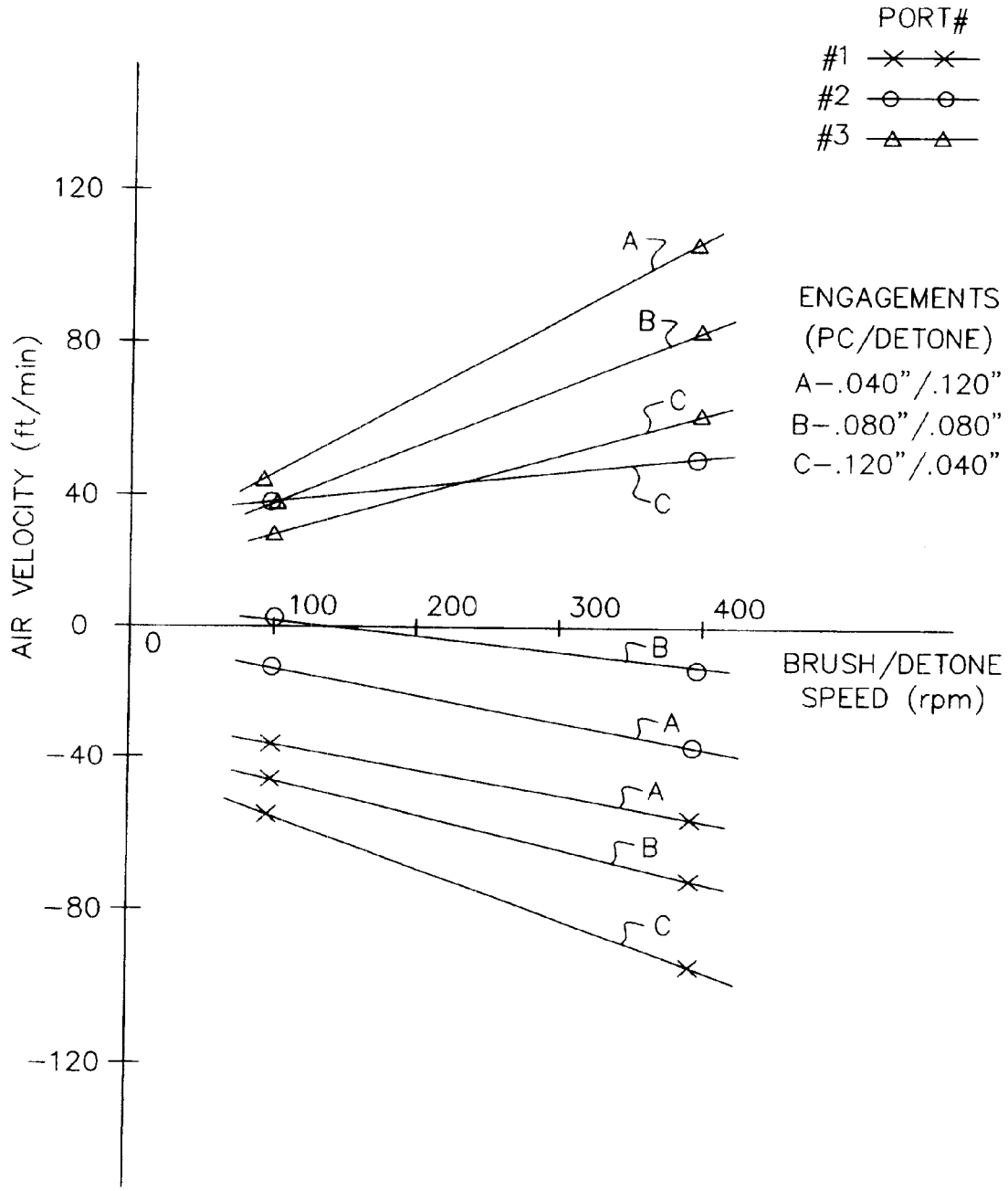
FIG. 5 is a graph of the air velocities of three ports plotted against the brush speed at various engagements.

Measurements of airflow velocities at Ports 1, 2 and 3 have been made with different combinations of engagement values at the two nips as seen in FIG. 4. These measurements were made at two values of cleaning brush 12/detoner roller 14 speeds. In FIG. 5, air velocities at the three ports are plotted for three conditions of nip engagement values. Positive air velocity values indicate airflow out of the housing 18; inward flow for negative values. It can be seen that the air velocity at Port 2 can be made to flow inward or outward by changing the values of nip engagements of the cleaning brush 12 with the photoconductive drum 10 and the detoner roller 14. When the engagements of the two nips are equal, the airflow at Port 2 is near zero. With the photoconductive drum engagement at 0.040" and the detoner engagement at 0.120", an airflow velocity of 32 ft/min into the housing is shown, when the brush and detoner speeds are 400 rpm.

Port 3 airflow velocity, out of the housing, has been shown to increase nearly linearly with brush and detoner speeds. When the engagements are at the favorable levels given above (0.040"/0.120"), the air velocity at Port 3 increases by 20ft/min for each 200 rpm increase in brush/detoner speeds. This relative engagement of photoconductive drum 10 and detoner roller 14 to cleaning brush 12 is more effective than the other engagements illustrated in FIG. 5. As the rotational speed of the cleaning brush 12 and detoner roller 14 increase the advantage becomes more pronounced.

The concept of "nip pumping" could be used in any application where the generation of airflow at low pressure is needed. For example, a fiber brush, such as a paint roller, rotating against a fixed surface within a housing, could be used to process and remove particulate contaminants from air within an apparatus. Such a device could also be used to supply air for the cooling of electronic components or the ventilation of corona generating devices. If a brush with conductive fibers was used, in conjunction with a bias voltage, the device could be used as a source of ionized air, for the discharge of static charges.

In general, the air pumping characteristics of a fiber brush do not depend on the electrical properties of the fibers, and, therefore, can be utilized in any system where there is relative motion and interference between two or more members, at least one of which has a woven nap.

PARTS LIST

10 photoconductive drum
12 cleaning brush
14 electrically biased detoner roller
16 curved deflector plate
18 cleaning station housing
20 Skive
22 baffle

What is claimed is:

1. A system for controlling air flow within a housing comprising:

at least one moveable surface within the housing, the at least one movable surface creating an air flow from a first portion of the housing to a second portion of the housing;

a first member positioned in the first portion of the housing near the at least one movable surface within the housing such that the air flow is directed by the first member;

a plurality of openings within the housing that allows air to traverse the openings, the openings including a first opening near the first member to allow air into the housing from the air flow caused by the at least one movable surface and a second positioned at an opposite side of the housing to allow air out of the housing from the air flow caused by the at least one movable surface; and whereby, air traverses the openings under control of the air flow without requiring additional forces.

2. The system of claim 1 further comprising:

a surface bearing marking particles on a first side of the movable surface and a roller on a second side of the at least one movable surface;

the at least one moveable surface including a cleaning brush having a plurality of brush fibers in contact with the surface bearing marking particles so as to remove marking particles from the surface bearing marking particles; and the first member is positioned between the surface bearing marking particles on the first side of the housing and the roller is positioned on the second side of the housing.

3. The system of claim 2 wherein the at least one opening further comprises a first slot opening in the first portion of the housing and a second slot opening in the second portion of the housing.

4. The system of claim 2 wherein the surface bearing marking particles is a photoconductive surface employing toner for marking particles, the at least one moveable surface is a cleaning brush, and the roller is a detoner roller in juxtaposition to the cleaning brush to remove toner from the cleaning brush.

5. The system of claim 4 further comprising a skive contacting the detoner roller.

6. The system of claim 5 wherein the cleaning brush is contained on a rotating surface.

7. The system of claim 6 wherein the first member is a deflector plate attached to the housing on a side where the brush fibers are moving towards the detoner roller.

8. The system of claim 7 further comprising a second member within the housing to direct air flow.

9. The system of claim 8 further comprising a baffle attached to the skive, the baffle also being attached to and the housing on an opposite side from the deflector plate.

10. The system of claim 9 wherein the deflector plate is curved.

11. The system of claim 10 wherein the deflector plate is spaced about ⅛" from the cleaning brush.

12. The system of claim 4 wherein the brush fibers each having a conductive core surrounded by an insulating layer.

13. The cleaning system of claim 4 wherein engagement of the detoner roller to the cleaning brush compared to engagement of the surface bearing marking particles to the cleaning brush is within a range of 1:3 to 3:1.

14. The system of claim 4 wherein engagement of the detoner roller to the cleaning brush compared to engagement of the surface bearing marking particles to the cleaning brush is essentially three to one.

15. An air flow control system for electrostatographic reproduction systems comprising:

a control system housing;

a marking particle bearing surface having at least a portion extending into the control system housing;

a cleaning brush, within the control system housing, having a plurality of brush fibers that contact the marking particle bearing surface and a roller within the control system housing and adjacent to the cleaning brush, to remove marking particles from the cleaning brush;

a deflector plate attached to the control system housing and positioned near the cleaning brush to control air flow from a first portion of the control system housing to a second portion of the control system housing; and at least one opening within the control system housing.

16. The air flow control system of claim 15 further comprising a skive contacting the roller at a position away from the cleaning brush.

17. The air flow control system of claim 16 further comprising a baffle attached to the skive and the control system housing on an opposite side from the deflector plate away from the cleaning brush.

18. The air flow control system of claim 16 wherein engagement of the roller to the cleaning brush compared to engagement of the marking particle bearing surface to the cleaning brush is in the range of 1:3 to 3:1.

19. The air flow control system of claim 16 wherein engagement of the roller to the cleaning brush compared to engagement of the marking particle bearing surface to the cleaning brush is essentially three to one.

20. The air flow control system of claim 15 wherein the cleaning brush is contained on a rotating surface.

21. The air flow control system of claim 15 wherein the deflector plate is attached to the control system housing on a side where the brush fibers are moving towards the roller.

22. The air flow control system of claim 15 wherein the deflector plate is curved.

23. The air flow control system of claim 15 wherein the deflector plate is spaced about ⅛" from the cleaning brush.

24. The air flow control system of claim 15 wherein the brush fibers each having a conductive core surrounded by an insulating layer.

25. A method of forming an air flow control system for an electrostatographic reproduction system comprising the steps of:

providing a marking particle bearing surface adjacent to a cleaning system housing such that the marking particle bearing surface has at least a portion of the marking particle bearing surface within cleaning system housing;

placing a cleaning brush having a plurality of brush fibers within the cleaning system housing such that the brush fibers are contacting the marking particle bearing surface and further placing a roller within the cleaning system housing such that it contacts the cleaning brush with an engagement that removes marking particles from the marking particle bearing surface;

creating at least one opening within the cleaning system housing; and attaching a deflector plate positioned near the cleaning brush such that air flow within the cleaning system housing is directed in a predetermined manner.

26. The method of forming an air flow control system of claim 25 wherein the step of placing further comprises placing a skive on the roller.

27. The method of forming an air flow control system of claim 26 wherein the step of attaching further comprises attaching a baffle to the skive, the baffle also being attached to the cleaning system housing on an opposite side from the deflector plate, the baffle being attached in a manner to direct air flow towards the at least one opening.

28. The method of forming an air flow control system of claim 26 wherein the step of placing further comprises the brush fibers each having a conductive core surrounded by an insulating layer.

29. The method of forming an air flow control system of claim 26 wherein the step of placing further comprises placing the cleaning brush such that engagement of the roller to the cleaning brush compared to engagement of the marking particle bearing surface to the cleaning brush is in the range of 1:3 to 3:1.

30. The method of forming an air flow control system of claim 26 wherein engagement of the roller to the cleaning brush compared to engagement of the marking particle bearing surface to the cleaning brush is essentially three to one.

31. The method of forming an air flow control system of claim 25 wherein the step of placing further comprises the cleaning brush being on a rotating surface.

32. The method of forming an air flow control system of claim 25 wherein the step of attaching the deflector plate further comprises forming the deflector plate attached to the cleaning system housing on a side where the brush fibers are moving towards the roller.

33. The method of forming an air flow control system of claim 25 wherein the step of attaching further comprises forming the deflector plate such that it is curved.

34. The method of forming an air flow control system of claim 25 wherein the step of attaching further comprises forming the deflector plate such that it is spaced about ⅛" from the cleaning brush.

* * * * *